US006007687A

United States Patent [19]

Ullman et al.

[11] Patent Number: 6,007,687

[45] Date of Patent: Dec. 28, 1999

[54] METHOD AND DEVICE FOR SEALING A COVER PLATE FOR AN ELECTROLYTIC CELL

[75] Inventors: Anders Ullman; Martin Kroon; Sven-Erik Bohlin, all of Ljungaverk, Sweden

[73] Assignee: Akzo Nobel N.V., Arnhem, Netherlands

[21] Appl. No.: 09/084,021

[22] Filed: May 26, 1998

[30] Foreign Application Priority Data

May 30, 1997 [SE] Sweden ..... 9702079

[51] Int. Cl.[6] ..... C25B 9/00

[52] U.S. Cl. ..... 204/279; 204/286; 205/620; 29/529.1

[58] Field of Search ..... 204/286, 279, 204/253; 29/529.1; 205/620

[56] References Cited

U.S. PATENT DOCUMENTS 4,051,008 9/1977 Ford et al. ..... 204/266

FOREIGN PATENT DOCUMENTS 0 014 595A1 8/1980 European Pat. Off. .

*Primary Examiner*—Kathryn Gorgos
*Assistant Examiner*—Thomas H Parsons
*Attorney, Agent, or Firm*—Burns, Doane, Swecker & Mathis, L.L.P.

[57] ABSTRACT

The present invention relates to a method and a device for sealing a cover plate for an electrolytic cell. Prior-art cell constructions suffer from the problems of, inter alia, a short service life of certain materials and cracking in the materials which results in leakage, which makes it necessary to put the cell out of operation. The problem is solved by the present method of sealing a cover plate for an electrolytic cell, the cell having a base (2), in which risers (1) for the anodes of the cell are attached, the base consisting of at least one basic material with high thermal conductivity, preferably copper, and at least one cover plate (8) which is arranged on the basic material towards the inside of the cell, the riser having a sealing flange (6), to which the cover plate is connected, an additional plate being attached between riser and cover plate to act as a bellows (9; 20), said bellows being attached by welding (10; 11) to the sealing flange (6) of the riser and the cover plate (8), respectively.

11 Claims, 3 Drawing Sheets

METHOD AND DEVICE FOR SEALING A COVER PLATE FOR AN ELECTROLYTIC CELL

The present invention relates to a method of sealing a cover plate for an electrolytic cell. The invention also relates to a device in an electrolytic cell, where a cover plate is connected to a riser by means of an additional plate.

In a modern electrochemical cell according to the diaphragm process, current is supplied to anodes through risers, with which the anodes are associated in the cell (see FIG. 1 Prior Art). The risers are anchored in the cell base, which usually is made of a thick copper sheet. The electrode current is distributed by means of the thick copper sheet which constitutes the base of the cell. The anode riser is screwed to the base by means of nuts to a certain moment, which may be in the order of 60–70 Nm, and is adjusted such that the contact pressure between a protruding lug on the riser and the base shall give a permanent and good contact. The copper base is usually protected against corrosion inside the cell by a flexible rubber mat. This construction is safe and inexpensive and has been regarded as world standard for many years. The number of cells in operation with this type of construction exceeds 10,000 and the corresponding number of anodes in these cells is more than a million.

Since rubber mats have a limited service life of about one year on average, they have in recent years in more and more cases been replaced by a cover plate made of titanium (see FIG. 2 Prior Art). The seal between the titanium plate and the riser is in this case established by means of a special packing. Attempts have also been made to attach the cover plate directly to the riser by welding.

The electrochemical cell described above is generally used for chlorine production. In this electrochemical production, use is suitably made of a diaphragm arranged between anode and cathode to separate anode compartment and cathode compartment. This separation can also be accomplished by using semipermeable and/or ion-selective membranes in the electrolyte. Asbestos diaphragms have been used, but these are now being replaced by asbestos-free diaphragms. These asbestos-free diaphragms are considerably more expensive than the precursors but have a service life of more than 5 years, i.e. 4–5 times longer than that of conventional asbestos-free diaphragms. The expectations of the diaphragm cell operators using asbestos-free diaphragms are growing throughout the world. The successful attempts with these types of diaphragms result in their being today referred to as the best available technology. An important remaining bar to the new technology is the service life of the seal between anode riser and cell base.

A contact design in a construction where the cell base is protected by a rubber mat (FIG. 1) means that the cell must be opened 1–1.5 times a year for exchange of the seal, which corresponds well with the service life of asbestos diaphragms but not when using asbestos-free diaphragms with a life of about 5 years. Opening a cell without damaging the diaphragm is a difficult operation. Therefore the life of the diaphragm and the life of the seal must be synchronised. Although this has been improved to some extent, for instance, by the rubber mat being replaced by a cover plate (FIG. 2 Prior Art) and a seal (which can be made of e.g. a polymer) there is still the problem that the remaining seal restricts the life of the new and expensive asbestos-free diaphragm since merely a leaking seal (of normally 80–100 seals) is sufficient to close the cell and put it out of operation. A further complicating factor is that the anodes, owing to the size of the electrochemical cells, must be mounted in the cells in the place of operation.

EP-A1-0 014 595 concerns an electrochemical cell for production of chlorine alkali. This cell comprises a riser attached to a cell base and a cover plate which is directly welded to a flange of the riser. Apart from the tendency to crack owing to the force of expansion (about 2 mm difference in longitudinal expansion between titanium and copper in the cell base), the invention according to EP-A1-0 014 595 also has the drawback that it has been both difficult and expensive to accomplish a welding in situ, i.e. at the mounting site. The commercial application of EP-A1-0 014 595 has been very limited.

With the method and the device according to the present invention the above-mentioned problems have been solved by sealing a cover plate for an electrolytic cell. According to the invention, a method of sealing a cover plate for an electrolytic cell is provided, the cell having a base, in which risers for the anodes of the cell are fixed, the base comprising at least one basic material with high electric conductivity, preferably copper, and at least one cover plate, which is arranged on the basic material towards the inside of the cell, the riser having a sealing flange, to which the cover plate is connected, an additional plate being fixed between riser and cover plate to serve as a bellows, said bellows being attached by welding to the sealing flange of the riser and the cover plate, respectively.

The invention also relates to a device for sealing a cover plate for an electrolytic cell, the cell having a base, risers for the anodes of the cell which are anchored in the cell base, a cover plate which is arranged on the base towards the inside of the cell, the riser having a sealing flange, the cover plate being connected to the sealing flange via a bellows which is anchored in the sealing flange and the cover plate, respectively.

The present invention solves the problems of cracking in the construction and has the advantage of acting as a flexible and resilient transition between anode riser and cell base/cover plate. The invention offers a reliable seal with a service life exceeding that of the actual cell. Further advantages are that the cell can relatively easily, but above all safely, be welded together under active-service conditions in the place of operation. With the construction according to the present invention individual anodes can now easily be exchanged.

The present invention can be applied to both newly manufactured and existing constructions with cover plates. The cover plate is suitably made of titanium and can be alloyed with, for instance, ruthenium and/or palladium and preferably has a thickness of from about 0.7 mm up to about 1.5 mm, or can be coated with a suitable protective layer based preferably on platinum metal or its oxides. An important advantage of the present method is that the cover plate can be provided with holes in all the places where anodes are to be arranged. In this embodiment, preferably also a bellows, or part of a bellows, has been attached by welding to the cover plate. In this fashion, the mounting operation is very simplified and can be made directly at the mounting site.

In the inventive method, an additional plate is preferably pressed from a thin elastic material to act as a bellows. The thickness of the metal sheet of the bellows is suitably in the range from about 0.2 mm up to about 1.0 mm, preferably from about 0.4 mm up to about 0.7 mm. The bellows is suitably made of titanium, preferably alloyed with one or more of the substances palladium, ruthenium and/or molybdenum, thereby avoiding corrosion in the welding joints. By preferably using a bellows of a thin material and suitably a certain shape, lateral forces from thermal expansion etc. can be absorbed without the stresses on the welding joint exceeding impermissible values.

The bellows may be designed in different ways. The bellows comprises at least one projecting part which is suitably made by, for instance, pressing a flat metal sheet as starting material. The forming or embossing can be carried out by deep drawing, hot moulding, vacuum moulding etc. The bellows suitably comprises a plurality of folded portions which form a number of projecting parts produced by a plurality of pressings in a metal sheet. The folded bellows can thus have the shape of the letter S or Z or, by a plurality of foldings, form a plurality of successive S's or Z's. At least part of the preferred projecting parts of the bellows should be relatively high so as to absorb thermal expansion. The height of the bellows can suitably be from about 10 mm and more. The upper limit is not critical but is set to be max. 50 mm for practical reasons. The height of the bellows is preferably in the range from about 15 mm to about 25 mm. The width of the bellows is preferably similar to the height to a corresponding degree and can suitably be in the range from about 10 mm to about 30 mm. The distance is suitably adjusted to ensure a good and reliable weld. Preferably the cover plate has a greater thickness of material than the metal sheet thickness of the bellows.

According to one embodiment, the bellows can also be formed with a smaller concentrically folded portion, also called pleats, on an optional side of the bellows. These pleats are adapted to absorb stresses, so-called directional stresses, which arise when fixing/directing the electrode. The pleats can be formed by a number of foldings of the bellows.

According to a preferred embodiment, the bellows is preferably divided. This can be effected such that the bellows is from the beginning suitably made in two separate parts, or a completed whole bellows is divided into two or more parts. The bellows is suitably divided in the portion with its highest or deepest folds, preferably in the vicinity of the highest point of the bellows. In the use of a divided bellows, that part of the bellows which should be arranged closest to the cover plate can first be welded to the cover plate. That part of the bellows which should be associated with the anode riser can suitably be welded to the anode riser before being welded together with the corresponding other part of the bellows which is fixed to the cover plate. The respective parts of the bellows which are associated with the anode riser and the cover plate, respectively, can suitably be welded in a workshop. The final mounting and welding together of the bellows and the respective parts are preferably carried out in the place of the plant. However, it is not critical in what order the weldings are effected or in what place if at least one of the weldings of the bellows is carried out in the place of operation. By using this method it is avoided that anodes for an entire cell must be welded to the cover plate when delivered, which is very inconvenient for industrial operation.

In the welding operation, use is suitably made of a reliable welding method such as TIG, plasma, laser or resistance welding.

The electrochemical cell described above can suitably be used for the production of chlorine alkali. In this electrochemical production, use is suitably made of a diaphragm arranged between anode and cathode to separate anode compartment and cathode compartment. This separation can also be achieved by using semipermeable and/or ion-selective membranes in the electrolyte.

With the design having a bellows according to the present invention, anodes can very easily be detached by using laser or cutting by means of a water torch, or by inserting a nibbling tool, a keyhole saw, a microplasma cutter or the like in the surface of the bellows; the bellows is suitably cut up and the anode can be removed. The actual welding surface of the riser is preferably again prepared for welding by trimming in a lathe, and the remainder of the old bellows is replaced by a new one which is welded to the anode before once more welding the anode to the cover plate. The welding surface of the cover plate where the bellows was attached can be prepared for new welding by using a hollow punch.

The invention will now be described by means of the accompanying drawings, which are only considered to illustrate embodiments and are in no way restricting the scope of the patent protection.

FIGS. 1 and 2 concern constructions according to prior-art techniques.

FIG. 3 illustrates the invention and an embodiment of the invention.

FIG. 4 concerns different embodiments of the bellows according to the invention.

Figure 1:
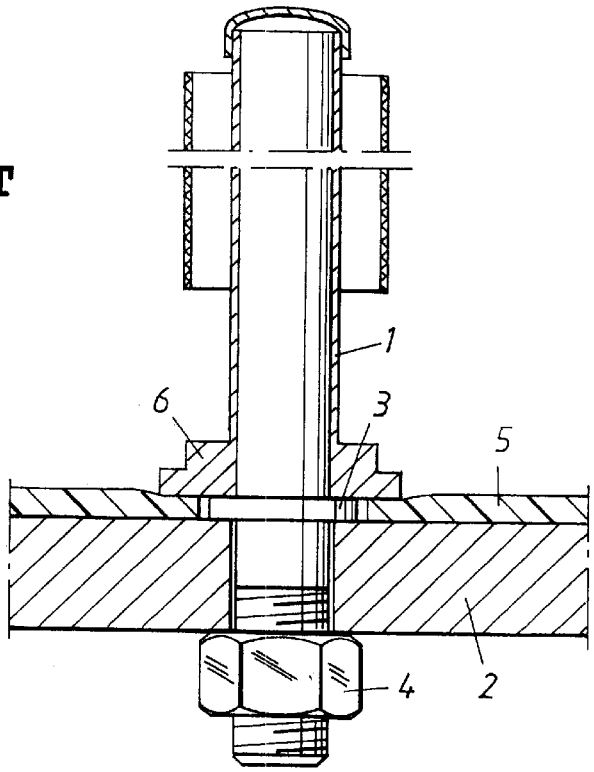
Fig. 1 PRIOR ART
FIG. 1 shows an electrochemical cell with an anode riser (1) attached by means of a nut (4) in the cell base (2), a flange (6) and a lug (3) on the riser, and a flexible rubber mat (5) arranged on the cell base.
Figure 2:
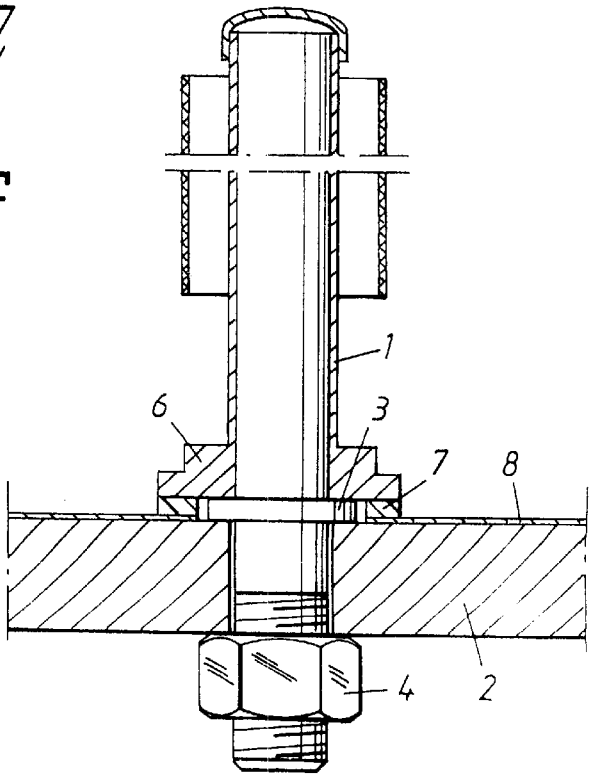
Fig. 2 PRIOR ART
FIG. 2 illustrates an electrochemical cell with an anode riser (1) attached by means of a nut (4) in the cell base (2), a flange (6) and a lug (3) on the riser, and a cover plate (8) arranged on the cell base. The seal between the titanium sheet and the riser is in this case established by means of a special seal (7).
Figure 3:
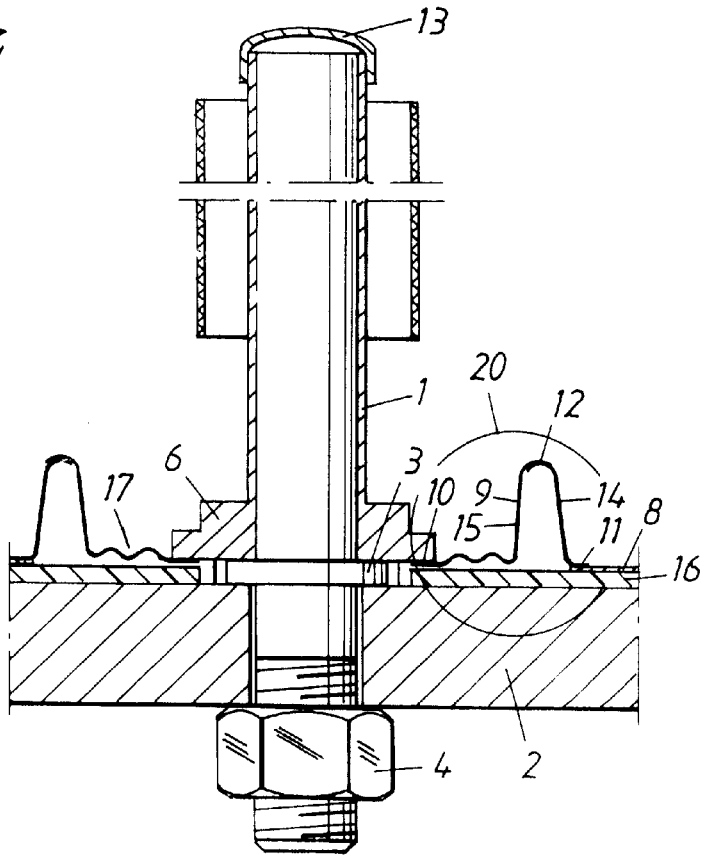

FIG. 3 concerns a construction of an electrochemical cell according to the present invention. The electrochemical cell comprises an anode riser (1) attached by means of a nut (4) in the cell base (2), a flange (6) and a lug (3) on the riser, and a cover plate (8), an insulation (16) arranged on the cell base (2). According to the invention, a bellows (9) in the form of an intermediate folded metal sheet is welded (10; 11) to the cover plate (8) and to the flange (6) on the riser (1). According to a preferred embodiment, the bellows (9) can, as shown in the Figure, be divided into two or more parts (14; 15). The welding (12) of the respective free ends (14; 15) of the bellows is then suitably effected only at the final mounting in situ. According to an embodiment (not shown) the insulation (16) can be relatively high, and the insulation with a cover plate (8) on top of the insulation can extend up to the highest point of the bellows at the welding joint (12). The bellows is, in this embodiment, welded at its highest point (12) to the cover plate. The thickness of the insulation can thus be in the range of 10–30 mm. The bellows can also be formed with pleats (17).

Figure 4:
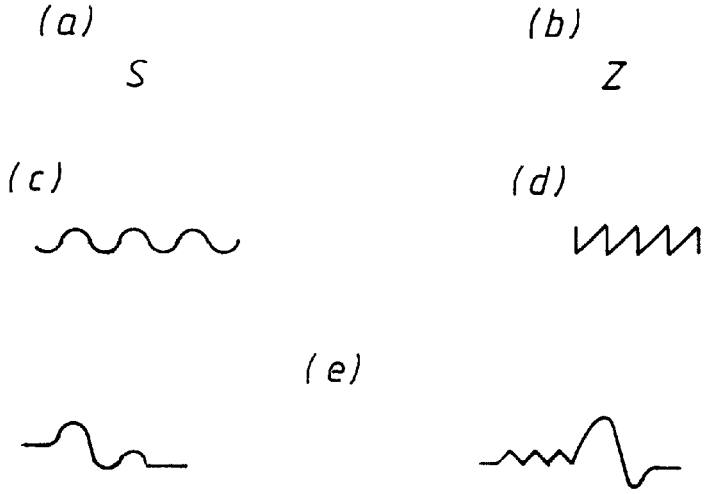

FIG. 4 shows a plurality of designs of the bellows (9) intended for various types of stresses. S shape (a), Z shape (b) or a plurality of interconnecting S (c) or Z (d) shapes or another varied folding (e).

Figure 5:
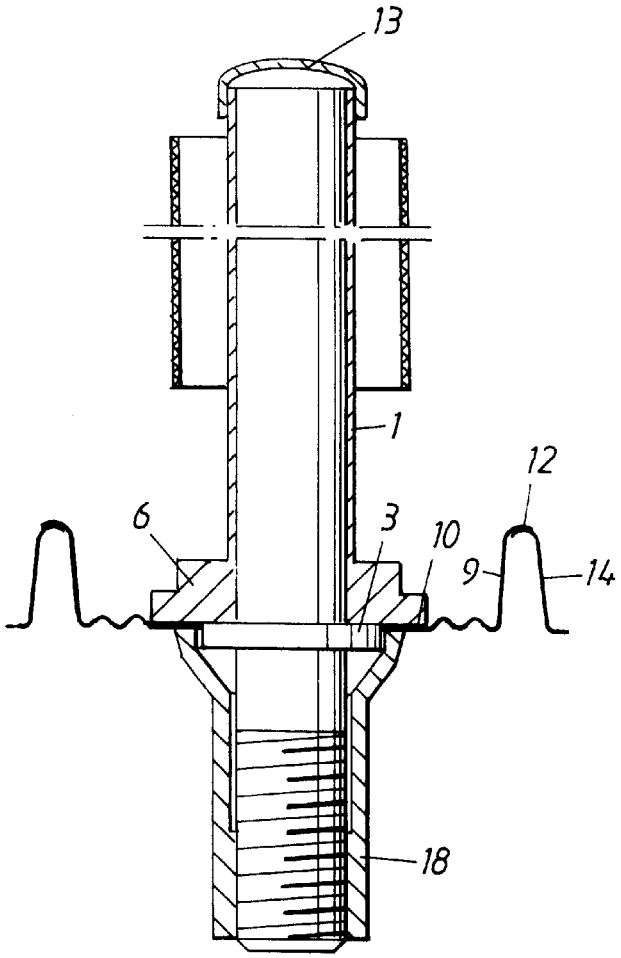
FIGS. 5 and 6 illustrate further embodiments according to the invention.

FIG. 5 shows a welding fixture for an electrochemical cell in an embodiment according to the present invention. The anodes should be arranged such that they are plane-parallel with the short side of the cell base and perpendicular to the cell base. This is suitably achieved by fixing the tip of the anodes and the flange (6) in a fixture where the anodes can be arranged upside/down. Above the thus arranged anodes, all bellows, alternatively a cover plate with bellows, are placed and fixing is effected by means of the welding fixture (18), which by means of threading locks the bellows against the flange (6), and then welding can take place (10).

Welding can also be carried out by means of a semiautomatic fixture which is attached to the fixture (18). According to the same principle, the bellows can now be locked (13), the fixture (18) being exchanged for a larger fixture according to the same principle which locks (13) the bellows. Thus, the welding fixture operates in such a manner that it uses the thread in the copper rod of the anode, the riser (1), as point of attachment, and makes it possible to press the thin bellows against the flange (6) and produce a weld (10). The welding fixture can also contain gas ducts for supplying protective gas in the vicinity of the weld (10) while at the same time it constitutes a point of fixing for a rotational fixture which is used to achieve a rotationally symmetrical welding joint (10) by letting the fixture rotate about the longitudinal axis of the anode.

Figure 6:
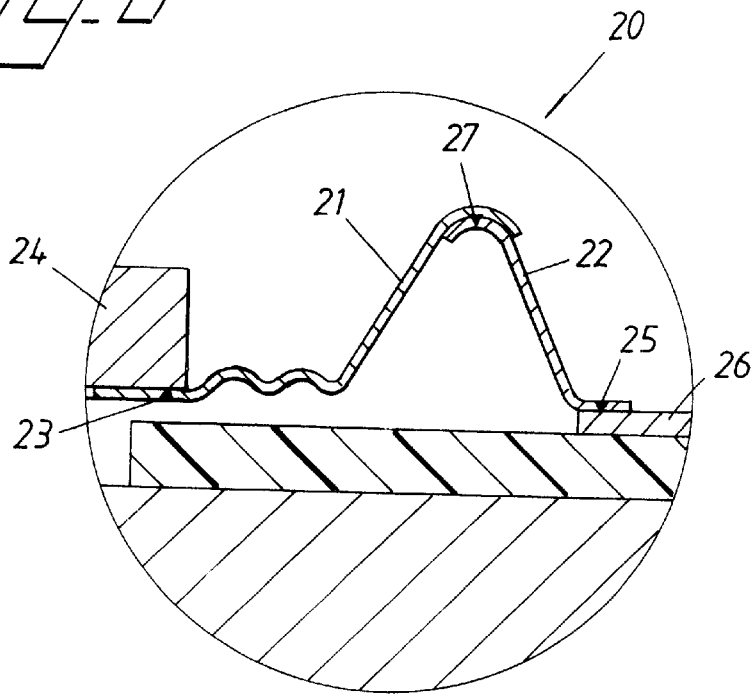

FIG. 6 illustrates in one more embodiment a bellows (20) in two parts, an inner bellows half (21) which is welded (23) to the flange (24), and an outer bellows half (22) which is welded (25) to the cover plate (26), and welding together (27) of the free ends of the bellow halves.

We claim:

1. A method of sealing a cover plate for an electrolytic cell, the cell having a base, in which risers for the anodes of the cell are fixed, the base comprising at least one basic material with high electric conductivity and at least a cover plate, which is arranged on the basic material towards the inside of the cell, the riser having a sealing flange, to which the cover plate is connected, characterised in that an additional plate is fixed between riser and cover plate to serve as a bellows, said bellows being attached by welding to the sealing flange of the riser and the cover plate respectively.

2. A method as claimed in claim 1, characterised in that the cell is adapted for use in the production of chlorine alkali.

3. A method as claimed in claim 1, characterised in that said cell contains at least one anode and one cathode, and that between the anode and the cathode there is arranged a diaphragm for separating an anode compartment and a cathode compartment.

4. A method as claimed in claim 1, characterised in that the bellows is divided and attached by welding when mounting the cover plate for the anode riser.

5. A method as claimed in claim 1, characterised in that the bellows comprises an inner and an outer bellows half, the inner bellows half being welded to the flange and the outer bellows half being welding to the cover plate, whereupon the bellows halves are welded together.

6. A method as claimed in claim 1, characterised in that bellows (9) is embossed by deep drawing, hot moulding or vacuum moulding.

7. A method as claimed in claim 1, characterised in that the cover plate has a greater thickness of material than the metal sheet thickness of the bellows.

8. A method as claimed in claim 1 characterized in that the at least one basic material with high electric conductivity is copper.

9. A device for sealing a cover plate for an electrolytic cell, the cell having a base, risers for the anodes of the cell which are anchored in the cell base, a cover plate which is arranged on the base towards the inside of the cell, the riser having a sealing flange, characterised in that the cover plate is connected to the sealing flange via a bellows which is anchored in the sealing flange and the cover plate, respectively.

10. A device as claimed in claim 9, characterised in that the bellows is divided.

11. A device as claimed in claim 9, characterised in that the bellows comprises an inner bellow half and an outer bellow half.

* * * * *